United States Patent [19]

Amtmann et al.

[11] 4,191,891

[45] Mar. 4, 1980

[54] X-RAY DIAGNOSTIC GENERATOR IN WHICH THE X-RAY TUBE VOLTAGE IS REGULATED VIA THE X-RAY TUBE CURRENT

[75] Inventors: Heribert Amtmann, Buckenhof; Hans Ebersberger; Günter Eckardt, both of Nuremberg; Hans-Joachim Greiner, Buckenhof, all of Fed. Rep. of Germany

[73] Assignee: Siemens Aktiengesellschaft, Berlin & Munich, Fed. Rep. of Germany

[21] Appl. No.: 959,231

[22] Filed: Nov. 9, 1978

[30] Foreign Application Priority Data

Dec. 22, 1977 [DE] Fed. Rep. of Germany ..... 2757505

[51] Int. Cl.[2] ..... H05G 1/30

[52] U.S. Cl. ..... 250/402; 250/409

[58] Field of Search ..... 250/402, 401, 408, 409, 250/413, 421

[56] References Cited

U.S. PATENT DOCUMENTS

| | | | |
|---|---|---|---|
| 3,846,633 | 11/1974 | Romandi | 250/408 |
| 3,939,352 | 2/1976 | Mester | 250/409 |

*Primary Examiner*—Craig E. Church

*Attorney, Agent, or Firm*—Hill, Van Santen, Steadman, Chiara & Simpson

[57] ABSTRACT

In an exemplary embodiment, the control circuit for controlling filament current to maintain x-ray tube voltage at a set point value is disabled near the beginning of an x-ray exposure by the cut-off of filament current to provide a falling load characteristic as a function of time. During the cooling of the x-ray tube filament, the x-ray tube voltage is maintained near its set point value by the timed switching of taps of a variable-ratio transformer to change the input voltage to the x-ray tube high voltage transformer, and by the coordinated changing of the loading of the primary circuit of such high voltage transformer, the control circuit for maintaining x-ray tube voltage at the set point value thereafter being placed in control of the filament current for the remainder of the x-ray exposure.

3 Claims, 3 Drawing Figures

X-RAY DIAGNOSTIC GENERATOR IN WHICH THE X-RAY TUBE VOLTAGE IS REGULATED VIA THE X-RAY TUBE CURRENT

BACKGROUND OF THE INVENTION

The invention relates to an x-ray diagnostic generator having a regulator circuit for the x-ray tube voltage which contains a comparator element for comparing the actual value of the x-ray tube voltage with a set point value, and also a control element responsive to the output signal of the comparator element for controlling the heating current of the x-ray tube in order to adjust the actual value of the x-ray tube voltage to the set point value.

An x-ray diagnostic generator of this type is described in the U.S. Pat. No. 3,974,387. In such an x-ray diagnostic generator, the voltage drop in the generator internal impedance is adjusted such that the respectively desired x-ray tube voltage is connected to the x-ray tube. If, for example, the actual value of the x-ray tube voltage in comparison to the set point value is too high, an increase of the x-ray tube current results. The voltage drop in the internal impedance of the x-ray generator increases thereby and the x-ray tube voltage decreases. In reverse, an increase of the x-ray tube voltage results by the reduction of the x-ray tube current.

It is known that an optimum utilization of the loadability of the x-ray tube, and thus a very short exposure time for the x-ray pictures can be obtained when an x-ray diagnostic generator is operated with a decreasing (falling) load characteristic wherein the x-ray tube output is exponentially decreased to a constant value from a peak value at the beginning of an x-ray exposure. Thereto, for example, it is known from the German Offenlegungsschrift 2,122,138, to exponentially decrease the x-ray tube current from a peak value at the beginning of an x-ray picture according to the course of the highest permissible x-ray tube power output. However, this principle cannot be utilized in an x-ray diagnostic generator of the initially mentioned type, as the x-ray tube current is indeed called upon to regulate the x-ray tube voltage.

SUMMARY OF THE INVENTION

The invention has the underlying objective to design an x-ray diagnostic generator of the initially mentioned type such that the x-ray tube current output is decreased from an initial value to a constant value during an x-ray exposure.

This objective is inventively resolved in that a variable-ratio transformer is connected in series with the high voltage transformer in order to stepwise switch the input voltage of the high voltage transformer, that at least one resistor, which can be switched into the circuit of the x-ray tube by means of a switch, is present and that the heater (filament) circuit of the x-ray tube, the variable-ratio transformer and the switch are connected to a timing control device which at programmed points of time firstly cuts off the x-ray tube heater supply then switches the resistor into the circuit of the x-ray tube and simultaneously increases the input voltage of the high voltage transformer by means of switching the variable-ratio transformer to a predetermined value, switches subsequently the input voltage back to the original value and then again switches on the x-ray tube heater circuit. In the inventive x-ray diagnostic generator, the output decrease of the x-ray tube proceeds by connecting at least one additional resistor. Thereby it is obtained that the x-ray tube voltage fluctuates only within relatively narrow limits by means of the switching processes described.

An expedient design of the invention provides an arrangement wherein a rectifier bridge lies in the primary circuit of the high voltage transformer, in whose DC current branch lies the parallel circuit consisting of switch and resistor elements.

The invention is subsequently more precisely explained with the aid of a sample embodiment illustrated in the accompanying sheet of drawings; and other objects, features and advantages will be apparent from this detailed disclosure and from the appended claims.

DETAILED DESCRIPTION

Figure 1:
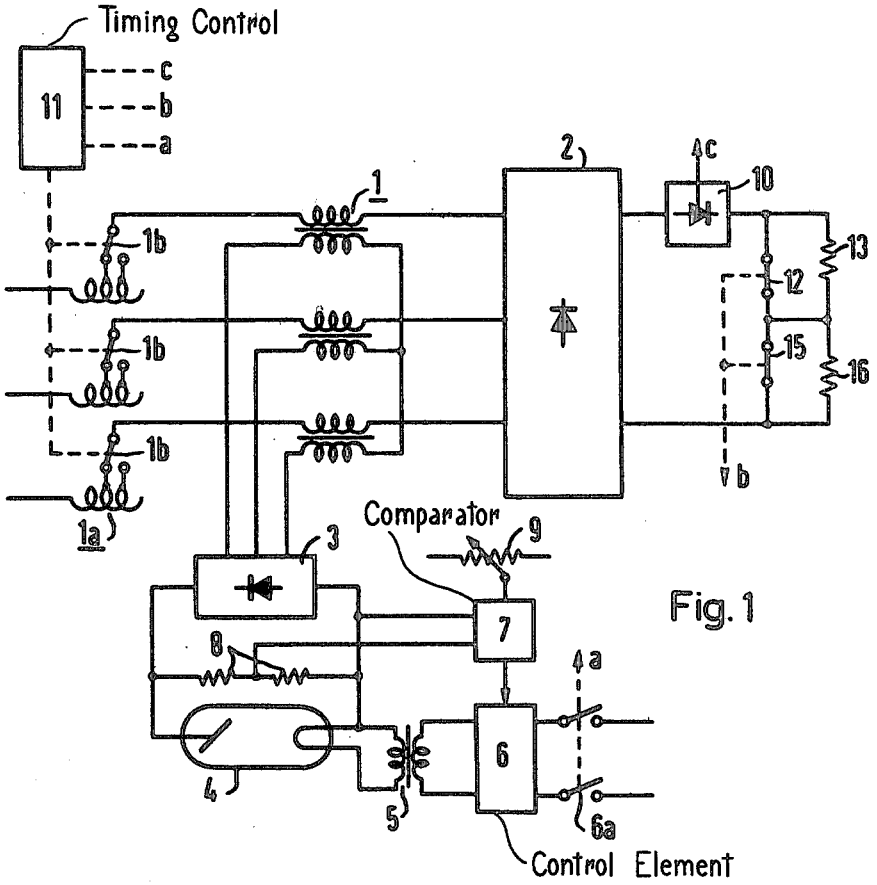
FIG. 1 illustrates a circuit diagram for the inventively essential components of an x-ray diagnostic generator according to the invention.

FIG. 1 illustrates a three-phase high voltage transformer 1 fed by the three-phase current network via a variable-ratio transformer 1*a*, and in whose primary circuit lies a three-phase rectifier bridge 2. The secondary windings of the high voltage transformer 1 feed an x-ray tube 4 via a high voltage rectifier 3. The filament (heating) current of the x-ray tube 4 is supplied by a filament transformer 5, whose primary winding is connected to the power supply network via a final control element 6 for controlling the filament current, and thus for indirectly controlling the x-ray tube current. A switch 6*a* is provided for interrupting the filament current.

The filament current is determined by a comparator 7 comparing a signal, corresponding with the actual value of the x-ray tube voltage, with a set point value signal tapped from a set point value generator 9 for the x-ray tube voltage, and influences the heating current of the x-ray tube 4 and thus the x-ray tube current in dependency upon the difference between the actual and the set point values of the x-ray tube voltage along the lines of an adjustment of the actual value to the set point value.

In the DC current branch of the rectifier bridge 2 lies an electronic switch 10 in order to determine the exposure time of an x-ray picture, the switch 10 being controlled by a timing control device 11 as indicated by line c. In order to decrease the x-ray tube power output during an exposure, the series connection consisting of two resistors 13, 16, is provided in the DC current branch of the rectifier bridge 2, said series circuit having a shunt circuit controlled by a switch 12, 15. Switch 6*a* and switch 12, 15 are controlled by the timing control device 11 as indicated by lines a and b. The timing control device 11 also controls switch 1*b* of the variable-ratio transformer 1*a*.

Figure 2:
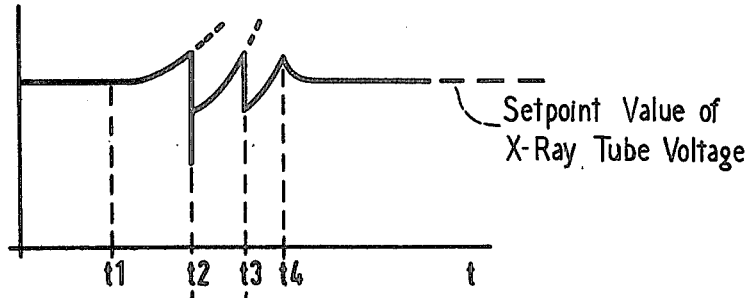
FIGS. 2 and 3 show voltage courses as a function of time in order to explain FIG. 1.
Figure 3:
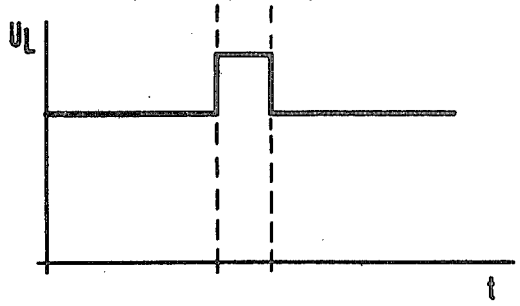

In the position of switch 12 and 15 illustrated, the maximum x-ray tube power output occurs at the beginning of an x-ray exposure which is initiated by the closing of switch 10. The timing control device 11 opens the switch 6*a* at the point of time t1 (FIG. 2) according to a preprogrammed time, and thereby cuts off the x-ray tube filament supply. The x-ray tube voltage in accordance with FIG. 2 exponentially increases to point of time t2. At that point of time, the timing control device 11 opens switch 12 and activates switch 1*b*. The resistor 13 is thereby connected into the circuit of the x-ray tube 4 and the x-ray tube power output is decreased. The supply voltage of the high voltage transformer 1 is simultaneously increased with the aid of switch 1*b* at the point of time t2. Due to the further cooling of the filament of the x-ray tube 4, the x-ray tube voltage increases further up to the point of time t3 according to FIG. 2. At that point of time, switches 1*b* are again reset in their position shown in FIG. 1 (and as represented by the supply voltage waveform $U_L$, FIG. 3), so that the x-ray tube voltage also decreases according to FIG. 2 and then further exponentially rises due to the additional cooling of the filament of the x-ray tube up to point of time t4. At that point of time, switch 6*a* is again closed and the heater circuit of the x-ray tube 4 is again switched on. The x-ray tube voltage is then adjusted to the desired (set point) value after a short delay.

The described control of the switches 12, 1*b* and 6*a* has the advantage that no impermissibly high deviations of the x-ray tube voltage from its set point value result with the decrease of the x-ray tube output current. An additional output decrease in a second stage (with switch 12 open) can be effected by the control of switches 6*a*, 15 and 1*b* according to the described switching sequence, whereby the resistor 16 is connected into the x-ray tube circuit in series with the resistor 13. Such a second switching sequence will again provide a falling x-ray tube current (to a still lower value) without impermissibly high deviations of x-ray tube voltage from the set point value.

In the framework of the invention it is imaginable to provide the variable-ratio transformer with three or more tappings, also. In that case, a decrease of the input voltage would firstly result—after the x-ray tube heater is cut off at a time corresponding to time t1, FIG. 2—by means of switching the variable-ratio transformer 1*a* to progressively lower voltage taps; with the subsequent switching into the circuit of the resistor 13 and a return to a higher voltage tap of the variable ratio transformer.

The invention is described in conjunction with two resistors which can be switched into the primary circuit of the high voltage transformer of an x-ray diagnostic generator. However, in the framework of the invention it is also imaginable to connect only one such resistor or more than two resistors according to the desired course of the output decrease during an x-ray exposure.

It will be apparent that many modifications and variations may be effected without departing from the scope of the novel concepts and teachings of the present invention.

We claim as our invention:

1. An x-ray diagnostic generator having an x-ray tube circuit for supplying x-ray tube voltage including a high voltage transformer, a regulator circuit for the x-ray tube voltage which contains a comparator element for comparing the actual value of the x-ray tube voltage with a set point value, an x-ray tube heater circuit for supplying x-ray tube filament current, and also a control element, controlled by the output signal of the comparator element for controlling the filament current of the x-ray tube in order to adjust the actual value of the x-ray tube voltage to the set point value, characterized in a variable-ratio transformer (1*a*) being connected in series with the high voltage transformer (1) for the stepwise switching of the input voltage of the high voltage transformer (1), the x-ray tube circuit including at least one resistor means (13, 16), and switch means (12, 15) for connecting the resistor means so as to change the x-ray tube voltage, the heater circuit of the x-ray tube (4), the variable-ratio transformer (1*a*) and the switch means (12, 15) being controlled such that firstly the x-ray tube heater circuit is cut off in order to decrease the x-ray tube output, thereafter the resistor means (13, 16) is connected to decrease the x-ray tube voltage and the input voltage of the high voltage transformer (1) is increased to a predetermined value by means of switching the variable-ratio transformer (1*a*), subsequently the input voltage is decreased, and then the x-ray tube heater circuit is switched on to provide for control of x-ray tube voltage at the set point value.

2. An x-ray diagnostic generator according to claim 1, characterized in that a rectifier bridge (2) lies in the primary circuit of the high voltage transformer (1), said rectifier bridge having a direct current branch including the switch means (12, 15) and the resistance means (13, 16) in parallel.

3. An x-ray diagnostic generator according to claim 1, characterized in that the resistance means comprises several resistances (13, 16) which can be connected in steps into the x-ray tube circuit by respective ones of the switch means (12, 15).

* * * * *